United States Patent [19]

Barlow

[11] 4,021,046

[45] May 3, 1977

[54] ACCUMULATIVE COMPARATIVE TIMING DEVICE

[75] Inventor: Gordon A. Barlow, Skokie, Ill.

[73] Assignee: Marvin Glass & Associates, Chicago, Ill.

[22] Filed: Aug. 16, 1976

[21] Appl. No.: 714,617

Related U.S. Application Data

[62] Division of Ser. No. 548,203, Feb. 10, 1975, Pat. No. 3,990,698.

[52] U.S. Cl. ..... 273/148 R; 58/153; 273/86 R; 235/104

[51] Int. Cl.[2] ..... A63D 9/00

[58] Field of Search ..... 273/86 R, 148 R, 1 E, 273/1 R; 58/153, 145 D, 39.5, 141; 35/22; 235/104; 310/49; 74/665 Q, 665 P, 665 G, 27, 405, 406, 384, 329

[56] References Cited

UNITED STATES PATENTS

| | | | |
|---|---|---|---|
| 1,269,944 | 6/1918 | Leonard | 74/329 |
| 3,088,270 | 5/1963 | King et al. | 58/39.5 |
| 3,270,334 | 8/1966 | Steele, Jr. | 273/1 E X |
| 3,503,608 | 3/1970 | Ylinen | 273/1 E |
| 3,558,132 | 1/1971 | Miller | 273/1 E |
| 3,568,334 | 3/1971 | Gregorio | 273/1 E X |
| 3,779,553 | 12/1973 | Secter | 273/1 E X |

FOREIGN PATENTS OR APPLICATIONS

| | | | |
|---|---|---|---|
| 549,359 | 4/1952 | Germany | 58/153 |

*Primary Examiner*—Richard C. Pinkham
*Assistant Examiner*—William R. Browne

[57] ABSTRACT

A timing device including an internal motor which rotates a pointer on an elapsed time dial which indicates the time periods required for the performance of respective events and for indicating the differences between the time periods when each time period is successively indicated on a common dial. A drive mechanism is movable between two positions. In one position the single time dial is caused to indicate increments of time for performing a series of successive events while in the other position the same single dial is caused to indicate decrements of time of the previously recorded periods of time. A timing governor is provided as a part of the drive mechanism, so as to regulate the output speed of the drive mechanism.

14 Claims, 10 Drawing Figures

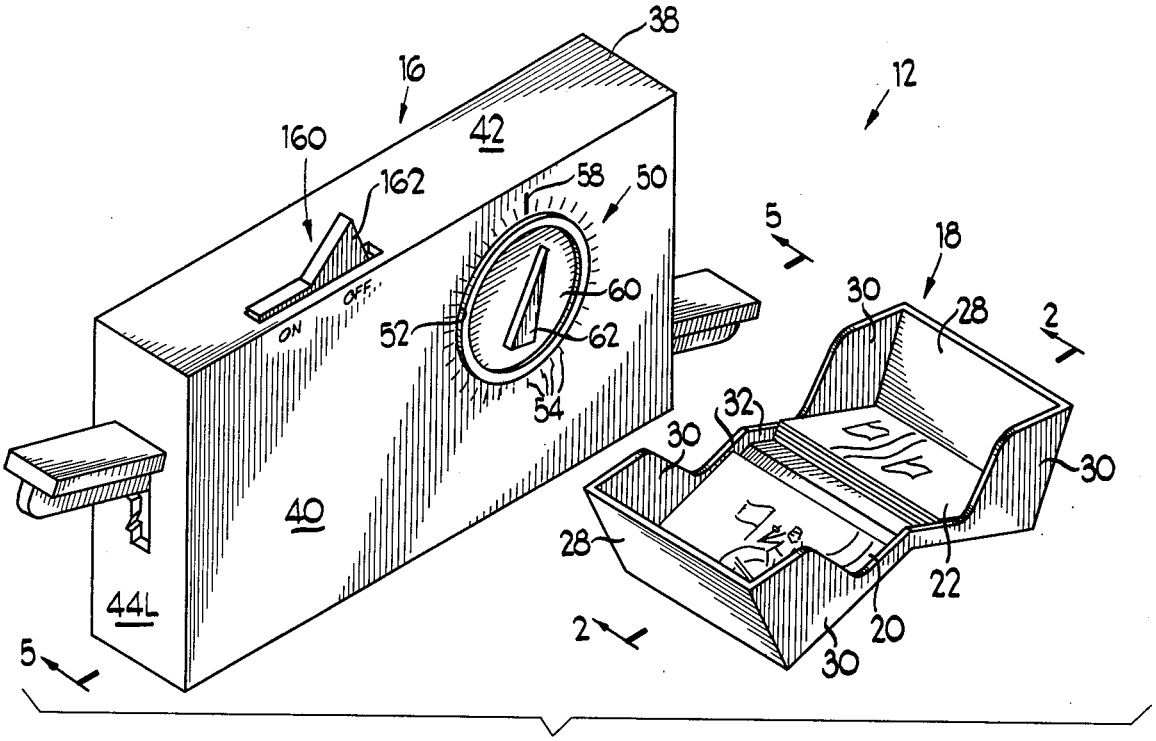
Fig 1
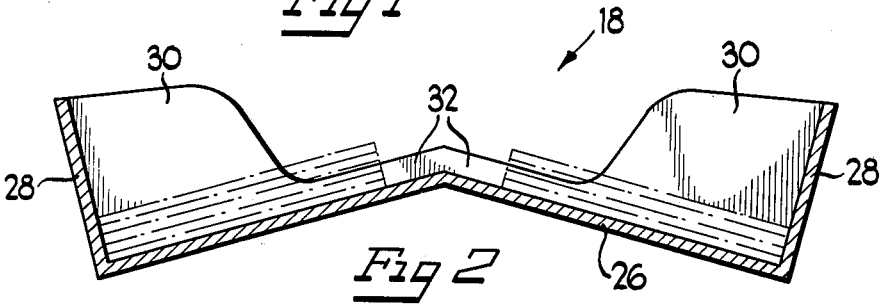
Fig 2
Fig 3
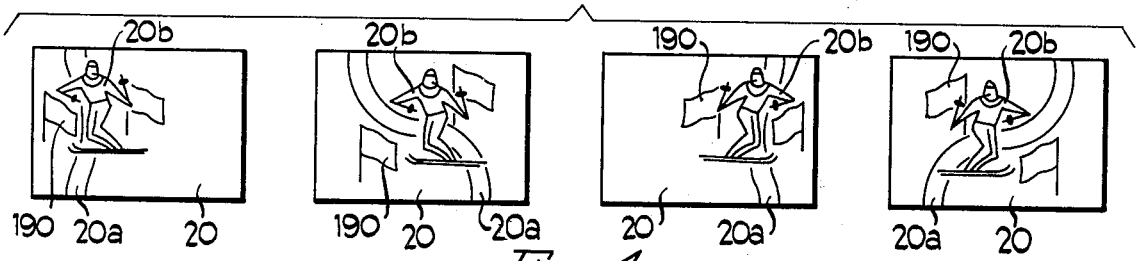
Fig 4
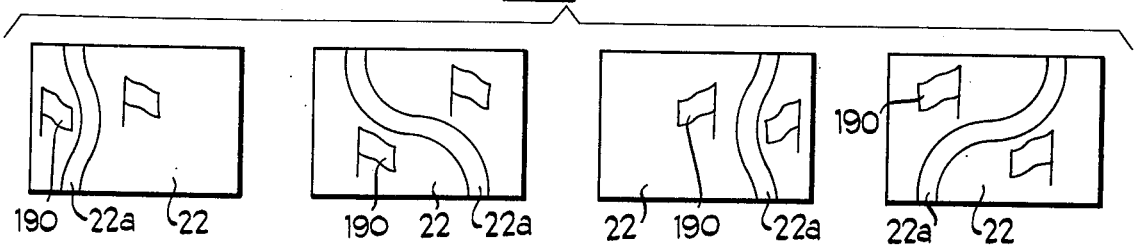

Fig 5
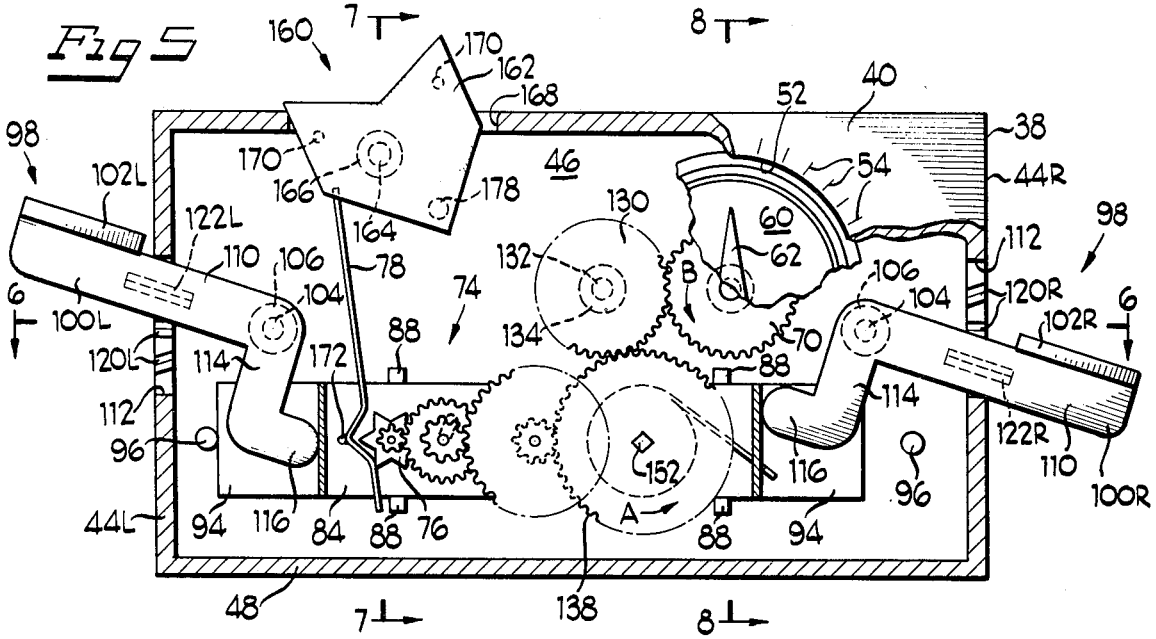
Fig 6
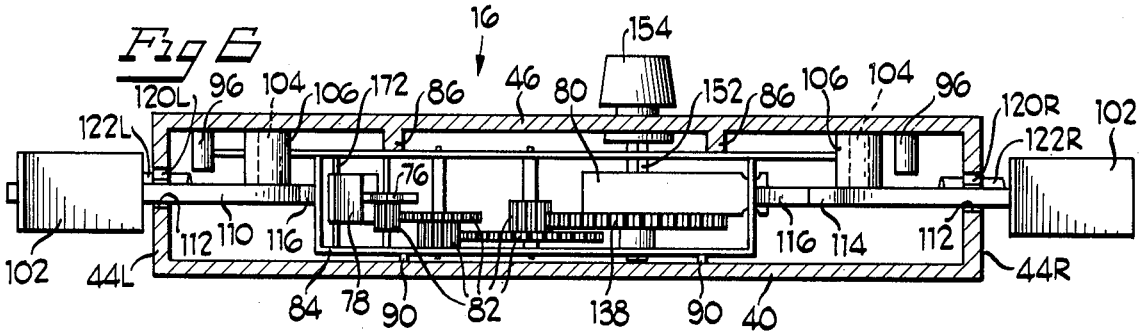
Fig 7
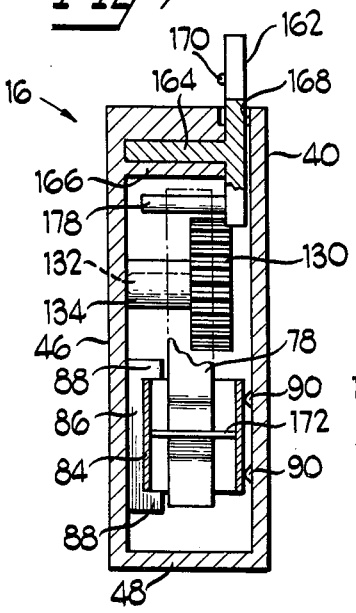
Fig 8
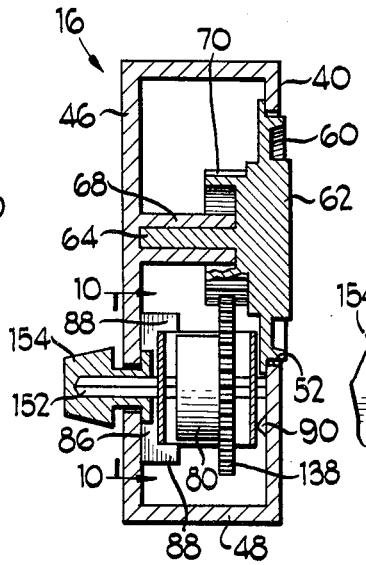
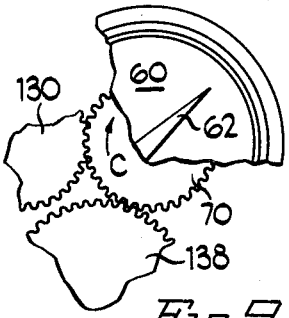
Fig 9
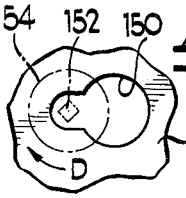
Fig 10

ACCUMULATIVE COMPARATIVE TIMING DEVICE

BACKGROUND AND SUMMARY OF THE INVENTION

Competition games wherein the object is to perform a particular task within a given time period have enjoyed a great deal of popularity throughout the years. In many games of this type a timer is used, and the timer simply is preset to provide a specific period of time in which one of the players must perform a given task in order to achieve a score. However, in most of these games, a player was not rewarded in any way if, for example, he achieved or performed the given task in less time than was permitted. Oftentimes, if all of the players of the game became proficient enough to perform the task within the given time period, the game either lost interest or it was necessary to reduce the length of the time period in order to make the game more challenging and interesting.

It is an object of the present invention to provide a new and interesting game which includes a timing device which automatically totals the amount of time used by each player in performing a task and calculates the difference between the times used. The timer will cumulate the time difference for a plurality of successive tasks to thereby indicate which player has used the least total amount of time for all of the tasks.

In accordance with the object of the present invention, a game is provided including two decks of playing cards and a timing device. One of the decks of playing cards each includes indicia on one side thereof, and the second deck of playing cards each includes indicia which is identical to a portion of the indicia on one of the cards of the first set so that the cards can be matched during the play of the game. A timing device is provided including a housing having a display means thereon for indicating the time differential between the amount of time which the players have used to perform their specific tasks, in this instance to match a card. A governor including a drive means is mounted within the housing so as to be movable between two positions. In one position, the governor increments the timer and in another position the governor decrements the timer so as to keep a comparative running indication of the time differential between the opposing players. The timing device includes a lever on each side which is manually actuated by the player as soon as he has performed his card matching task so that the timer immediately begins to run against his opponent.

The game apparatus includes two sets of playing cards. Each of the cards of one set includes indicia on one side representative of a skier traversing a path on a skiing slope between a pair of markers or flags. Each of the cards of the second set include indicia which is identical to the path of travel and flags on one of the playing cards of the first set so that during the play of the game a card from the second set can be matched with a card from the first set by matching the identical indicia portions, i.e., the paths of travel and flags.

Other objects, features and advantages of the invention will be apparent from the following detailed description taken in connection with the accompanying drawings.

BRIEF DESCRIPTION OF THE DRAWINGS

FIG. 1 is a perspective view of the components of the game apparatus of the present invention;

FIG. 2 is a vertical section, on an enlarged scale, of the card holder, taken generally along the line 2—2 of FIG. 1;

FIG. 3 is a representation of one of the two sets of playing cards and the various indicia carried thereby;

FIG. 4 is a representation of the second set of playing cards and the various indicia carried thereby;

FIG. 5 is a vertical section, on an enlarged scale, of the timer, taken generally along the line 5—5 of FIG. 1;

FIG. 6 is a horizontal section taken generally along the line 6—6 of FIG. 5;

FIG. 7 is a vertical section taken generally along the line 7—7 of FIG. 5;

FIG. 8 is a vertical section taken generally along the line 8—8 of FIG. 5;

FIG. 9 is a fragmented vertical section, similar to that of FIG. 5, showing the relevant portions of the drive means in an alternate position; and FIG. 10 is a fragmented vertical section of the winding knob of the timer, taken generally along the line 10—10 of FIG. 8.

DESCRIPTION OF THE PREFERRED EMBODIMENT

The game apparatus of the present invention, generally designated 12, is shown in FIG. 1 and includes a timer, generally designated 16, a card holder, generally designated 18, and two decks of cards 20 and 22 as seen in the card holder 18 and in FIGS. 3 and 4, respectively.

Referring more particularly to FIG. 2, the card holder 18 includes a V-shaped base 26 having two upstanding end walls 28 formed at right angles with the two sides of the base 26. The end walls 28 are formed integrally with a pair of side retaining walls 30 which are also formed at 90° with the base. The side walls 30 are reduced in height near the central portion of the holder, as at 32, to facilitate easy removal of the cards 20 and 22 from the holder.

Examples of the two sets of playing cards 20 and 22 can be seen in FIGS. 3 and 4, respectively. A first set of playing cards 20 includes first indicia **20*a* thereon representative of varying winding portions of a ski track or path along a ski slope or the like, and second indicia 20*b* thereon showing a skier traversing the path. The cards in the second set of playing cards 22 (FIG. 4) each carry indicia 22*a* representative of a winding path of travel along a ski slope which is identical to the path 20*a* shown on one of the cards from the first set 20** but with the skier removed.

The object of the game is to match, as fast as possible, a playing card 20 with a skier from the first set with a playing card 22 from the second set which has an identical path of travel. Thusly, as viewed in FIGS. 3 and 4, the cards directly above and below one another form matched sets. During the play of the game, one of the players plays or lays down a card 22 representative of a path of travel and the opposing player must then match that card by placing on top of it one of the cards 20 from the first set carrying a skier and having an identical path of travel along the ski slope. Of course, it is contemplated that the indicia carried by the cards may be representative of a large variety of other sports or other indicia and the use and discussion herein referring to skiers and slopes is only exemplary of what indicia may be provided and no unnecessary limitations should be understood therefrom.

The timer 16 as shown in FIGS. 1 and 5 through 10 is provided to keep track of the amount of time used by a particular player in making a match between a opponent's playing card 22 and one of his playing cards 20. The timer is started at a reference point 58 (FIG. 1) at the beginning of a game, and increments in one direction away from the reference point to indicate use of time by a first player and decrements in the other direction to indicate time being used by a second player. During a decrementing period, the timer may return past the reference point 58 thereby indicating that the second player has used more time to perform a match than the first player had used. This process is continued throughout the play of the game without ever requiring the timer to be reset so that, at the end of the game, the timer is stopped after the last play and will indicate which player has used more time to perform his matches. Since each successive time period moves the timer in a reverse direction, the amount of time represented on the timer corresponds to the difference between the total amount of one player versus the total amount of time used by the other player.

More particularly, referring to FIG. 1, the timer includes a generally rectangular housing 38 which includes a front wall 40, a top wall 42, two side walls 44, a rear wall 46 and a base or bottom wall 48. A display means, generally designated 50, is provided on the front wall to indicate the amount of elapsed time as described above. The display means 50 includes a large circular aperture 52 in the front wall 40 which is surrounded by, in this case, a plurality of equally spaced radially directed notches or lines 54 which represent arbitrary periods of time, such as a second or the like. The top or uppermost vertical line is used as a starting or reference point 58 and it is contemplated that the remaining notches may be identified by numbers increasing in both directions from the reference point 58. A circular dial 60 is rotatably mounted within the aperture 52 and carries a pointer 62 which is aligned with the reference point 58 at the beginning of the play of the game.

Referring to FIG. 8, the dial 60 includes a rearwardly directed axle or shaft 64 which is received by a journal or axle support 68 which extends forwardly from the rear wall 46 in a concentric relationship with the center of the aperture 52. The disc 60 also carries a rearwardly mounted output gear 70 (FIGS. 5, 8 and 9) which is used to rotate the pointer 62, as described in detail below.

Referring more particularly to FIGS. 5 and 6, a governor or drive means, generally designated 74, is mounted within the housing 38 to drive the disc and pointer 60 and 62. The drive means 74 is a common Aladdin type motor having a starwheel 76 engageable with a pivoted leaf 78 to provide a release mechanism or governor. The drive means 74 (FIG. 6) includes a drive motor 80 in the form of a manually wound spring motor which is gearingly connected to the starwheel 76 by a plurality of intermediate gears 82 which reduce the torque applied by the starwheel 76 to the leaf 78. The drive means 74 is mounted within a rectangular frame 84 as viewed from the top, as in FIG. 6. The rectangular frame is slidably mounted within the housing by a pair of U-shaped supports 86 mounted on the rear wall. The U-shaped supports 86 each include a pair of forwardly directed tabs 88 which vertically support the frame 84. A plurality of rearwardly directed tabs 90, formed on the front wall 40, hold the frame 84 within the supports 86 so that the drive means 74 is free to move or slide back and forth from the left to the right and vice versa. The rear wall of the governor frame 84 includes two rectangular extensions 94 (FIG. 5) which limit the travel of the governor in either the right or the left direction. Stop means in the form of a pair of forwardly directed post 96, mounted on the rear wall in alignment with the movement of the governor 74, engage the extensions 94 alternately as the governor is moved from the righthand extreme to the lefthand extreme and vice vesa.

Selectively operable actuating means, generally designated 98 (FIG. 5), including a pair of manually actuatable levers 100R ad 100L, moves the drive means 74 back and forth within the housing. The levers are pivotally mounted by pins 104 and journals 106 which extend forwardly from the rear wall 46 of the housing. The levers 100L and 100R are generally Z-shaped having a long arm 110 extending from the pivot points outwardly through a rectangular opening 112 in the side walls 44R and 44L of the housing for mounting finger pads 102R and 102L, respectively. A generally vertical portion 114 of the levers extends generally downwardly from the pivot pin 104 and carries a generally horizontally extending tab or cam surface 116 for engaging the frame 84 of the drive means 74. The cams 116 and levers 100R and 100L are formed of such length so that when one of the levers is in the downwardmost position the other of the levers is in is uppermost position, as shown in FIG. 5 Therefore depressing one of the levers, for example 100R, to its lowermost position moves the other lever 100L to its uppermost position.

Detent means in the form of three notches 120 (FIGS. 5 and 6) on the apertures 112, and a tab 122 provided on the lever portions 110, maintain the levers 100R ad 100L in a preset position. The three notches 120 provide three stable or equilibrium positions for each lever 100L and 100R. When the righthand lever 100R is in engagement with its uppermost notch 120 time will run against the player associated with the righthand lever while the lefthand lever 100L will be in its lowermost position engaging the lowermost notch 120. Similarly, when the righthand lever is in its lowermost position and the lefthand lever is in its uppermost position the timer will run against the player associated with the lefthand lever 100L.

The timer includes first and second means for timing the occurrence of subsequent events and a comparator means for calculating the timer difference between the two or more events. Said first, second, and comparator means include an intermediate gear 130 (FIGS. 5 and 7) which is mounted by a shaft 132 in a journal 134 extending frontwardly from the rear wall. The intermediate gear 130 is always in engagement with the output gear 70 of the dial 60. However, the intermediate gear and the output gear 130 and 70 are alternately in engagement with a drive gear 138 (FIGS. 5, 6 and 8) of the spring motor 80. In use the drive gear 138 will always rotate in a counterclockwise direction as shown by arrow A (FIG. 5).

When the drive means 74 is in its left position as shown in FIG. 5, the drive gear 138 engages the intermediate gear 130 which will rotate in a clockwise direction (FIG. 5) which causes the output gear and thus the pointer 62 to also rotate in a counterclockwise direction as shown by arrow B in FIG. 5. Alternatively, after the lefthand lever 100L has been depressed, the drive means 74 has moved to the right and the drive gear 138 is in engagement directly with the output gear 70 to cause the pointer 62 to rotate in the opposite direction or a counterclockwise direction as shown by arrow C in FIG. 9. Thus, the direction of rotation of the pointer is reversed simply by depressing the lever 100R or 100L which is in the upper position which causes the drive means 74 to move either into engagement with the intermediate gear 130 or the output gear 70 depending upon which lever is depressed.

FIG. 10 shows a partial section of the rear wall 36 and includes a generally keyhole shaped cutout 150 for a clearance path for the winding shaft 152 of the spring motor 80. A winding knob 154 is mounted on the shaft 152 externally of the rear wall 46 so that the spring motor 80 can be rewound simply by rotating the knob 154. To wind the motor 80, the winding knob 154 is rotated in a direction shown by arrow D in FIG. 10.

A neutral position is provided in which the drive gear 138 does not engage either the intermediate gear 130 or the output gear 70. The provision of a neutral gear is desirable since at the end of the game, prior to the beginning of a new game, the pointer 62 must be reset in alignment with the reference point 58 and the motor 80 must be rewound. Referring to FIG. 5, the drive means 74 is moved to the intermediate neutral position by depressing the lever 100L only half way so that the notch 122L engages the intermediate or middle notch 120L in the aperture 112. Thus, both of the levers 100R and 100L will be approximately horizontal and the drive gear 138 will not engage the intermediate gear 130 or the output gear 70. This permits the pointer 62 and disc 60 to be rotated freely of the drive means 74 and permits the drive motor 80 to be wound.

Finally, an on-off switch, generally designated 160 (FIG. 5), is provided to stop the drive means 74 when it is not in use, as between games when a new set of cards is being distributed. The off-on switch includes a pivotally mounted arrow-head shaped portion 162 on the top 42 of the housing. The switch portion 162 includes a rearwardly directed mounting shaft 164 which is supported in a journal 166 (FIG. 7) provided on the interior of the top wall 42. The switch portion 162 is mounted within a rectangular opening 168 so that the two rearwardly directed portions extend upwardly and outwardly of the housing. Adjacent the switch, on the front of the housing, is indicia indicating that the drive means is on or off depending upon which side of the switch portion 162 has been depressed. Two small rearwardly directed tabs or nipples 170 are provided on the rearward side of the switch 162 to engage the surfaces of the aperture 168 to maintain the switch in either of its two positions.

The leaf 78 adjacent the starwheel 76 is pivotally mounted to the frame 84 by a pin 172 (FIG. 5) so that the leaf 78 is free to move. As the starwheel 76 rotates the leaf 78 must pivot back and forth to allow the passage of the point of the starwheel 76 for continued rotation. Stopping of the leaf 78 in any position will stop the starwheel 76 so that it cannot continue to rotate. Thus, the drive means 74 can be stopped, as desired, merely by preventing oscillating movement of the leaf 78. To this end, a rearwardly directed shaft 178 (FIG. 5) is provided near the pointed end of the switch 162 so that, as the switch is moved to the off position, the shaft 178 will engage the leaf 78 and prevent it from oscillating about the pin 172. The starwheel 76 is thereby stopped and thus the drive means 74 and the drive motor 80 will be stopped until the switch is moved to the on position.

The game can be played by two or more players but is specifically designed so that two players or teams can participate at a particular time. Thus, if more than two players are playing the game, the pairs must alternate at different intervals. As mentioned previously, the object of the game is to match the cards from the sets 20 and 22. One form of playing the game is that, at the beginning of the game, each of the players is dealt a predetermined number of cards from each deck 20 and 22. The timer is set with the pointer 62 in alignment with the reference point 58 and the spring motor 80 is wound while the switch 160 is in the off position. One of the players begins the game by placing one of his path of travel cards 22 on the card holder 18 and he starts the timer 16 running against his opponent by depressing or "slapping" his lever 100. The opponent must then match the path of travel card 22 with a card 20 carrying an identical path of travel and a skier. Once his match is made, he immediately then plays one of his path of travel cards 22 by placing it on the other side of the card holder 18, after which, he depresses his lever 100 to start the time running against the first player. The game is continued by the players alternately matching their opponent's card and playing a card 22 for the opponent to match while alternately switching the timing device 16 to cause the timer to run against the opponent. When all of the cards have been played, the timer is stopped by depressing the off-on switch 160 to the off position after which the timer can be read to see which player has taken the most amount of time. Each notch or line 54 is representative of one point and is read to determine how many points a particular player has achieved. Thus, as shown in FIG. 1, if the pointer is on the second notch to the right or clockwise direction of the reference point, the player associated with the lefthand lever 100L would be awarded two points since he has used less time to accomplish the matches than his opponent associated with the righthand lever 100R.

Additional points are awarded for mismatches which may occur because of the hectic and fast moving nature of the game. Thus, if the player associated with the righthand lever 100R has mismatched one of his sets of playing cards, the opponent will be awarded one additional point for the mismatch and thus with a two point time advantage will win with a total score of three points. Therefore it would be possible that a particular player could use more time to make his matches than his opponent but still end up as a winner because of his greater accuracy in making matches.

In order to make the game more interesting and difficult, it is also contemplated that additional indicia can be added to the sets of playing cards 20 and 22 to require additional accuracy by the players when attempting to make matches. As previously described above, matches were achieved by comparing the configuration of the paths of travel on the cards of each set and forming a match between one card from each set having a path of travel of identical configuration. Additional indicia in the form of markers or flags 190 of varying colors can be provided along with the path of travel on the cards 20 and 22. Thus, in order to make a match between cards of the two sets, it would be required not only to match the configuration of the path of travel 20*a* and 22*a* but also to match the color of the markers or flags 190 on each card. Of course, many other variations of the indicia on each set of cards would be possible without departing from the spirit of the present invention.

The foregoing detailed description has been given for clearness of understanding only and no unnecessary limitations should be understood therefrom as some modifications will be obvious to those skilled in the art.

I claim:

1. A time device, comprising:

a first means for transmitting motion representing time required for the performance of a first given task;

a second means for transmitting motion representing time required for a second player to perform a subsequent given task; and third means for indicating the time periods required for the performance of the respective tasks and for indicating the difference between the time periods when each time period is successively indicated on a common indicator.

2. The timer of claim 1 wherein said third means includes means for cumulating the time differences between continuous alternate performances of given tasks to provide a cumulative time differential for the respective performance of all of the events.

3. The timer of claim 1 wherein said first and second means comprises drive means mounted on a housing, said drive means being movable between a first position wherein said first task is timed and a second position wherein said subsequent task is timed.

4. The time of claim 3 wherein the third means includes display means mounted on the housing for indicating a time differential and means for alternately engaging said display means with said drive means to increment said display means when the drive means is in said first position and decrement said display means when the drive means is in said second position.

5. The timer of claim 4 wherein said display means includes a pointer which is secured to an output gear rotatably mounted on the housing, an intermediate gear rotatably mounted in meshing engagement with said output gear, and said drive means being alternately engageable with said output gear and said intermediate gear when in said first and second positions, respectively, to move the pointer in opposite directions.

6. The timer of claim 5 including selectively operable actuating means associated with said drive means for moving the drive means between said first and second positions.

7. The timer of claim 6 wherein the actuating means includes a pair of actuators mounted on the housing for opposing players for independently moving said drive means between said first and second positions.

8. A timer for use with a game or the like for indicating time differential between the elapsed time periods for the occurrence of successive events, comprising:

a housing including display means, said display means indicating;

drive means mounted on the housing, for aiding in operating the display means, said drive means being movable between a first position wherein the display means indicates increments of time for performing one or more given events and a second position wherein the display means indicates the decrements of time of the said one or more given events; and selectively operable actuating means associated with said drive means for moving the drive means between said first and second positions.

9. The timer of claim 8 wherein the actuating means includes a pair of actuators mounted on the housing for opposing players for independently moving said drive means between said first and second positions.

10. The timer of claim 9 wherein the actuating means includes a pair of levers pivotally mounted on the housing having a portion of each lever extending outwardly of the housing for selective manual operation whereby depressing one of said levers moves the drive means to a first position and depressing the other of said levers moves the drive means to a second position.

11. The timer of claim 8 wherein the display means comprises a rotatable pointer mounted on the housing, said rotatable pointer being rotated by said drive means in one direction for indicating an incrementing time period and rotated in the opposite direction for indicating a decrementing time period so that, after the occurrence of successive events the display means will indicate the time differential between said time periods.

12. The timer of claim 11 wherein the pointer is secured to an output gear rotatably mounted on the housing, said output gear being in meshing engagement with an intermediate gear rotatably mounted on the housing, said output gear and said intermediate gear being selectively, alternately engageable with said drive means in the first and second positions, respectively.

13. The timer of claim 12 wherein said drive means is slidably mounted on the housing and includes a drive gear on the drive means for alternately engaging the output gear and the intermediate gear as the drive means is slidably moved from the first position to the second position.

14. The timer of claim 13 wherein the drive means includes a timing governor to regulate the output speed of said drive means.

* * * * *